United States Patent [19]

Florence

[11] Patent Number: 4,646,212

[45] Date of Patent: Feb. 24, 1987

[54] RECESSED LIGHTING FIXTURE

[75] Inventor: Noel S. Florence, New York, N.Y.

[73] Assignee: Lightolier Incorporated, Secaucua, N.J.

[21] Appl. No.: 798,469

[22] Filed: Nov. 15, 1985

[51] Int. Cl.[4] ..... F21S 1/02

[52] U.S. Cl. ..... 362/150; 362/225; 362/249; 362/290; 362/342; 362/365

[58] Field of Search ..... 362/150, 148, 225, 249, 362/290, 291, 292, 342, 346, 347, 365, 404, 433

[56] References Cited

U.S. PATENT DOCUMENTS 3,155,324 11/1964 Chen ..... 362/219
3,816,880 6/1974 Jacobs ..... 362/150
4,407,011 9/1983 Lahm ..... 362/217
4,494,175 1/1985 Gawad et al. ..... 362/290

*Primary Examiner*—E. Rollins Cross
*Attorney, Agent, or Firm*—Arthur B. Colvin

[57] ABSTRACT

A lighting fixture and ceiling structure incorporating same are disclosed. The fixture may be securely mounted within a ceiling grid work assembly by a simple downward movement of the fixture. Ceiling board is supported by being mounted on flanges integral with the fixture on the one hand and elements of the supporting grid on the other. The fixture and grid work interact so as to effect an accurate positioning of the fixture relative to the grid work by taking advantage of centering formations integral with the grid work.

12 Claims, 6 Drawing Figures

RECESSED LIGHTING FIXTURE

BACKGROUND OF THE INVENTION

1. Field of the Invention

The present invention is in the field of lighting fixtures and is directed more particularly to a compact recessed lighting fixture of the fluorescent lamp type, especially adapted for simplified installation in ceiling structures of the so-called "Esposed T-bar grid type".

2. The Prior Art

A popular form of conventional ceiling structure includes a grid work defined by individual frame sections of generally inverted T-shaped cross-section. The frame sections are formed into a series of rectangles, the frame members being supported, as by wires depending from structural components of the building, the lowermost ends of the wires being passed through apertures formed in the vertical web of the frame sections. Conventionally, the ceiling grid is divided into 2 foot by 4 foot rectangles which construction permits easy access to various electrical and mechanical devices within the plenum above the ceiling.

Heretofore, the interior designer was compelled to employ in such ceiling structures relatively large 2 foot by 4 foot size fixtures designed for four fluorescent lamps or to change the grid structure at intervals to accommodate a desired smaller 1 foot by 4 foot fixture designed for two lamps. In the latter case, the ceiling pattern must change wherever a lighting fixture is required. Future changes of fixture arrangement would require rebuilding the ceiling. The present invention allows a small fixture to be placed anywhere within a ceiling comprising a regular array of 2 foot by 4 foot grid spaces and to be easily relocated without changing the ceiling grid.

SUMMARY OF THE INVENTION

With the foregoing in mind, the present invention may be summarized as directed to an improved ceiling fixture, and to a novel ceiling construction employing the improved fixture. In accordance with the invention, which is especially made and adapted for use with the conventional 2 foot by 4 foot ceiling grid work, there is provided a fixture member the lengthwise dimension of which corresponds to the 4 foot lengthwise dimension of the grid work rectangles, and the widthwise dimensions of which is substantially one-third of the widthwise dimension of the rectangles defined by the structure, i.e. nominally 8 inches.

A characterizing feature of the fixture resides in the provision of novel mounting means whereby the fixture may be securely mounted to the grid work by a simple downward movement whereby the ends of the fixture are sleeved over the T-shaped frames defining the grid work. The fixture includes novel attachment mechanisms which snap over the grid work, and particularly the vertically directed element thereof, the fixture in the mounted position being locked against upward relative movement with respect to the grid work. Optionally, but preferably, the fixture includes detent means which cooperate with spaced slots formed in the grid work members, the slots being accurately positioned at the center of each end portion of a 2 foot rectangle whereby, by passing the detent means through the centering slot, the fixture is accurately centered with respect to each rectangle.

A further characterizing feature of the invention resides in the provision along the longitudinal edges of the fixture, i.e. the 4 foot dimensional components thereof, of horizontally directed ledges. By virtue of providing such ledges, it is possible to support an 8 inch by 4 foot ceiling board section with its longitudinal edges supported on one side by a flange of the T-bar grid structure, and on its other side by a ledge portion of the fixture.

A particular advantage of the dimensional and mechanical characteristics of the fixture of the present invention resides in the ability of the installer to cut the conventional 2 foot by 4 foot ceiling boards into three equally sized pieces, each grid structure being filled precisely by a centrally located fixture in accordance with the invention, the fixture supporting to either side an 8 inch by 48 inch section of ceiling board.

As will be appreciated from the foregoing, it is an object of the present invention to provide improvement in fluorescent lighting fixtures and ceiling structures incorporating the same characterized in that installation in conventional 2 foot by 4 foot ceiling grid constructions may be easily and accurately effected.

Still a further object of the invention is the provision of a ceiling structure incorporating fixtures of the type described characterized in that the mounting of the fixture within the ceiling structure and the locating of the fixtures in spaced relation with respect to the ceiling structure may be rapidly and accurately completed.

Still a further object of the invention is the provision of a fixture of the type described wherein the same may be securely and permanently affixed to the grid structure of a ceiling by a simple downward relative movement of the fixture with respect to the ceiling structure.

In order to attain these objects and such other objects as may appear herein or be hereinafter pointed out, reference is made to the accompanying drawings in which.

Figure 1:
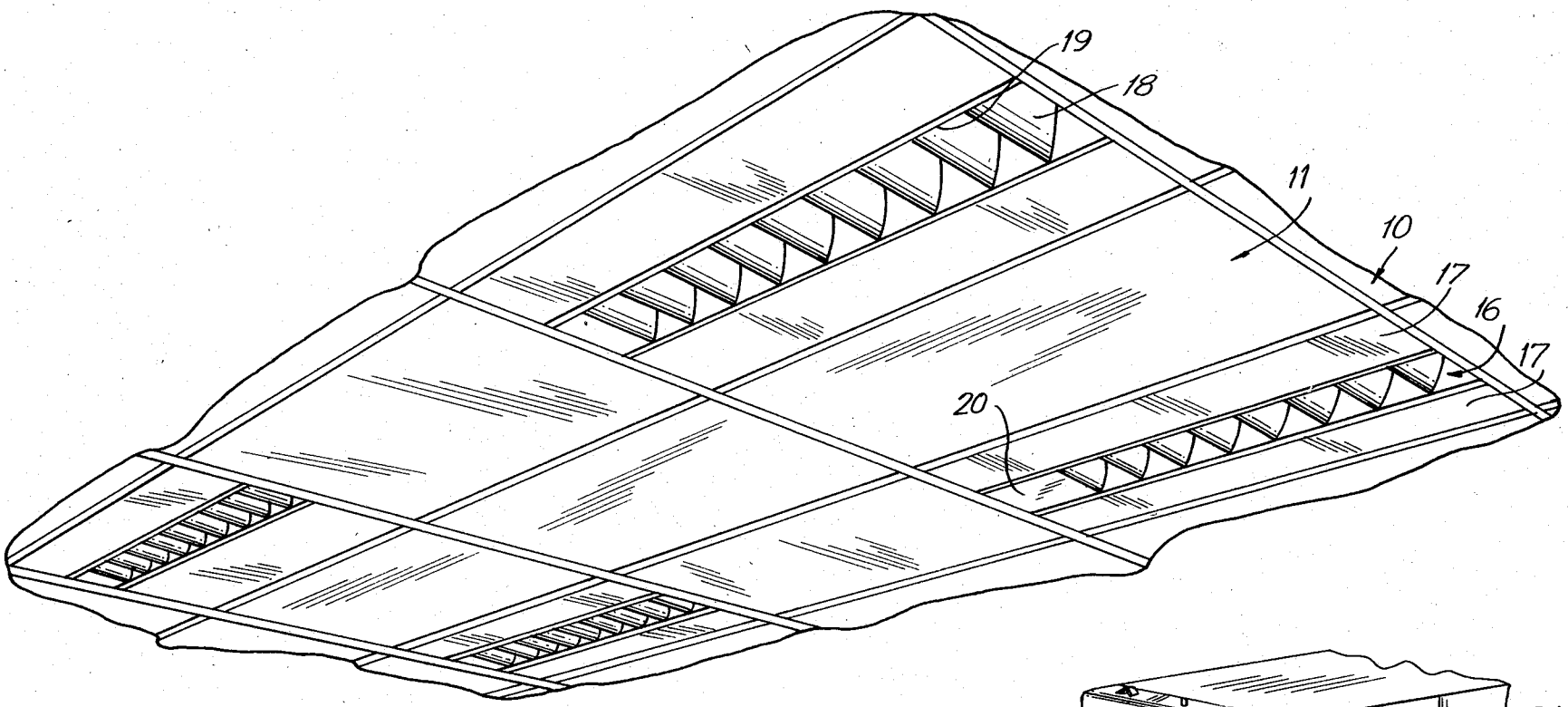
FIG. 1 is a perspective view of a ceiling structure from below, the structure being formed utilizing fixtures in accordance with the invention.

In accordance with the invention there is shown in FIG. 1 a ceiling structure which is comprised of a grid work 10 defining a series of rectangles 11 comprised essentially in accordance with current practice of 2 foot by 4 foot rectangular spaces.

As will be discussed more fully hereinafter, the grid work is formed of a plurality of interconnecting frame sections 12 which sections are generally in the form of an inverted T including vertical upstanding web portions 13 having a longitudinally directed enlargement 14 at the uppermost end thereof, and laterally directed horizontally disposed flanges 15, the flanges projecting to opposite sides of the web 13.

As is known in the art, the frame sections defining the grid structure are suspended in spaced relation to the building superstructure as by depending wires hanging from the superstructure and passed through apertures formed in the web member 13.

In accordance with the preferred embodiment, each of the rectangles 11 is 2 feet by 4 feet in dimension, i.e. the space between opposed vertical web members defining the extremities of the rectangles is substantially 2 feet by 4 feet.

In accordance with the preferred embodiment of the invention, a series of fixtures 16 are disposed within selected ones of the rectangles, the dimensions of the fixtures being 8 inches in width by 4 feet in length. Thus in accordance with the preferred embodiment, each of the rectangles which supports a fixture is defined by a pair of 8 inch wide panels 17,17 of ceiling board and a central lighting fixture 16.

As will be apparent from the foregoing, it is possible to cut a conventional nominal 2 foot by 4 foot ceiling board component into three equal 8 inch components, there thus being no wastage of ceiling board.

The fixtures may include internal parabolic louver blades 18 as best seen in FIG. 1, or alternatively may include a flat diffuser 20 or lenses. The fixture generally may be comprised of a light housing portion 21 which carries the electrical components and sockets for the fluorescent bulbs, and a louver assembly 22. The light housing 21 and louver assembly 22 are in effect integrated into a single housing component as by spring fingers 23,23 secured to interior components of the louver assembly and projecting outwardly through corresponding slots 24,25 in the light housing 21.

Figure 5:
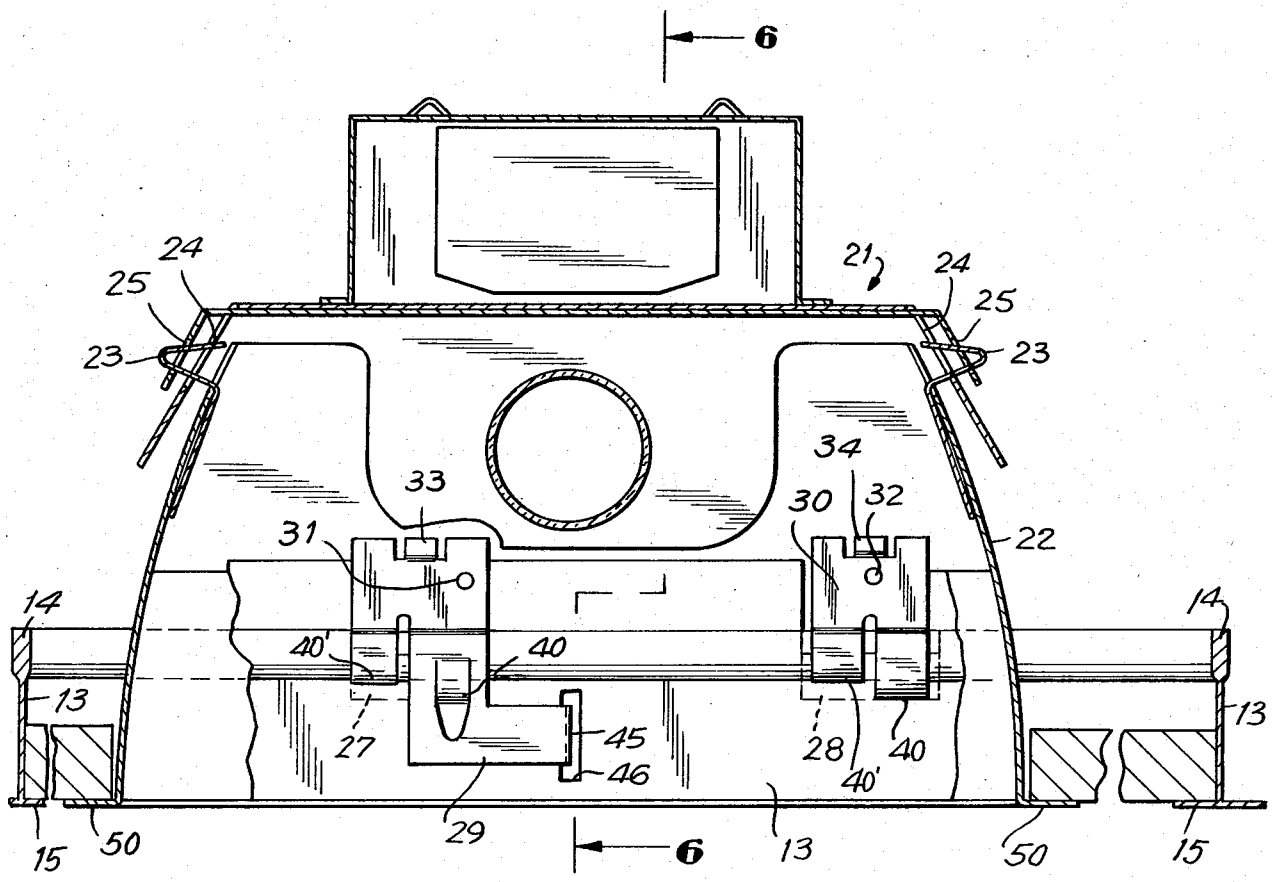
FIG. 5 is a transverse vertical section taken on the line 5—5 of FIG. 4.

As will be appreciated from an inspection of FIG. 5, for instance, the connection between the louver assembly and light housing 21 is such as to provide ventilating slots between the noted parts. Since the mode of connection of light housing and louver assembly, 21 and 22 respectively, forms no part of the instant invention, the elements will be referred to jointly in the claims as the housing.

A characterizing feature of the present invention resides in the means by which the lighting fixture is mounted to the grid structure defined by the frame members 12.

In accordance with the invention the light housing 21 which is connected to the louver assembly includes at its extremities end portions 26. The end portions 26 include first and second inverted U-members 27,28 respectively, the U portion 27 being offset to one side of the longitudinal center line of the fixture and the portion 28 being disposed adjacent an edge portion of the fixture at the other side of the center line. Since the end portions 26 which are secured at opposite ends of the fixture are identical, but are secured to the fixture in reverse orientation, it will be appreciated that the U-member 28 at one end of the fixture will be disposed adjacent one side longitudinal edge of the fixture, whereas the end portion 28 at the opposite end of the fixture will lie adjacent the opposite longitudinal edge of the fixture thereby providing a high degree of stability after mounting. Also, since the U-members are offset at opposite ends of the fixture, it is possible to mount fixtures in end butting relation without interference between the U-member of the respective fixtures.

While U-members 27,28 may be formed integrally with end portion 26, it is preferred that the U-members be defined partly by tabs 27',28' comprised of parts of the end members, and end members 29,30 secured to the end portions 26 as by rivets 31,32. In order to preclude pivotal movement between the members 29,30 and the end portion, the members 29,30 may include tabs 33,34 which project outwardly through apertures 35,35 formed in the end member 26.

Figure 6:
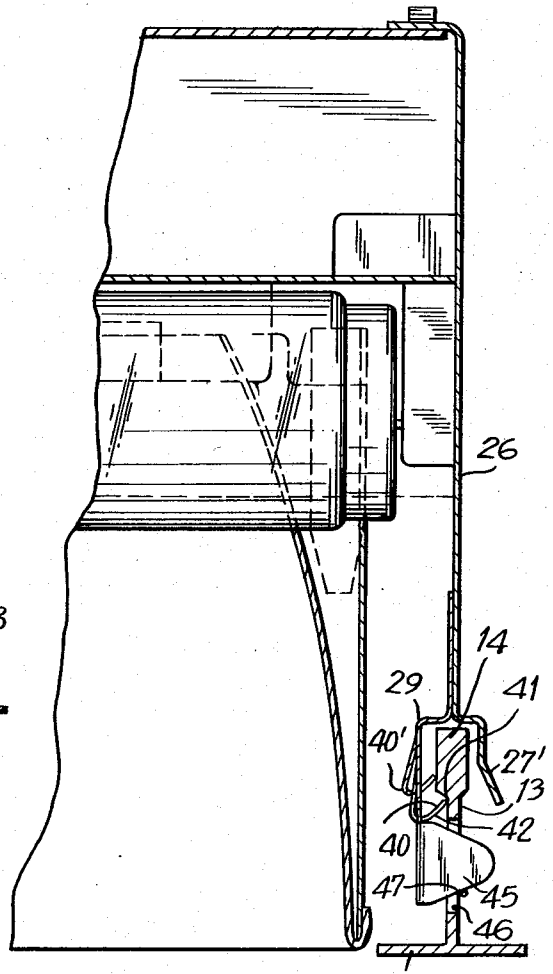
FIG. 6 is a discontinuous section taken on the line 6—6 of FIG. 5.

As best seen in FIGS. 2, 3, 4 and 6 the U-members include outwardly directed hook portions adapted to encircle enlargement 14 at the upper ends of vertical webs 13 of the grid structure. More specifically, as best seen in FIG. 6 the member 29 includes hook portion 40 which underlies shoulder 41 of the enlargement 14. The hook portion 40 includes a downwardly directed cam surface 42 whereby when the fixture is forced downwardly, spring member 29 is temporarily deflected inwardly to enable the hook 40 to pass below the shoulder 41.

Optionally, but preferably, each of the members 28 and 29 is provided with a pair of hook members 40 and 40' located at different vertical positions, the vertical differentiation between the heights of the hook members enabling the fixture to be used in conjunction with the two standard frame sections common to the industry, the frame sections differing in the heightwise extent of the enlargement 14 thereof.

As will be obvious from the preceding discussion, when the device is utilized in conjunction with a T section such as is shown in FIG. 6 of substantial vertical extent, the same will be engaged by the hook 40. Where a T section in which the enlargement portion 14 is of smaller vertical extent, it will be the shorter hook portion 40' which will underlie the shoulder 41 of the enlargement.

The member 29 includes in addition to the hook portions a horizontally directed detent 45 which projects outwardly from the member 29. As will be appreciated from the succeeding discussion, it is the function of the detent 45 to enter into vertical slots 46 which are formed at precisely spaced positions longitudinally of the conventional T frame sections. The normal function of slots 46 is to cooperate with other elements of the grid assembly. However, as will be apparent from the succeeding discussion, the slots 46 are employed as a means of accurately and readily locating the sidewise position of the fixtures 16 within the various rectangles.

As best seen in FIG. 6 the detents 45, which as noted function as the centering tabs, include an inclined or cammed lower surface 47. As will be more fully explained hereinafter, it is the function of the cam face 47 to deflect the detents 45 inwardly when the fixture is implaced within a grid structure.

The manner of assembly of the fixtures to the grid structure will be apparent from the preceeding description. After the T-shaped grid structure defining the multiplicity of rectangles 11 has been assembled to the building superstructure, and it is determined which of the noted rectangles are to be filled with lighting fixtures, the fixtures are secured within the respective grids by a simple downward movement of the fixture relative to the grid.

Figure 2:
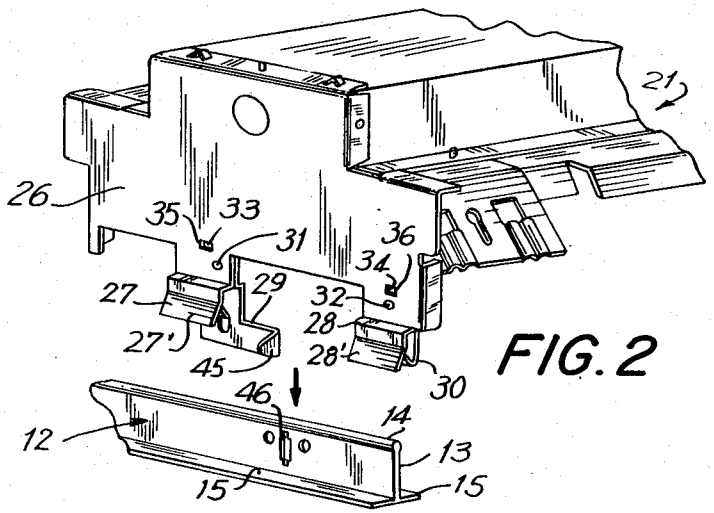
FIG. 2 is a fragmentary end view in perspective of a fixture in accordance with the invention showing details of the means for connecting the fixture to a component of the ceiling grid work.
Figure 4:
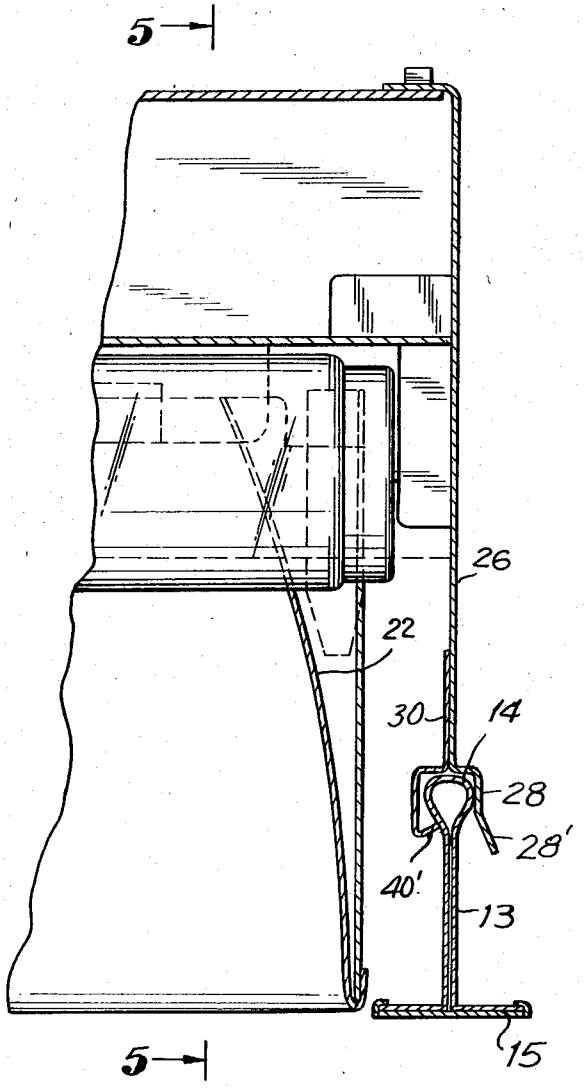
FIG. 4 is a magnified vertical section taken on the line 4—4 of FIG. 3 and includes the louver assembly not shown in FIGS. 2 and 3.
Figure 3:
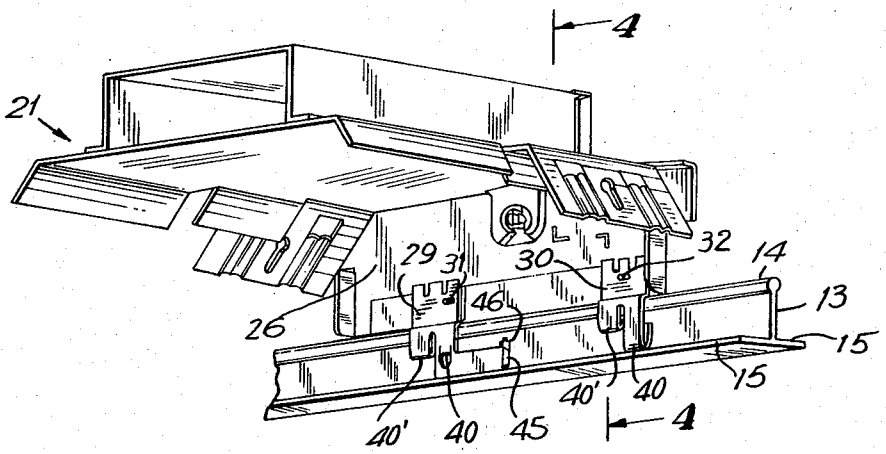
FIG. 3 is a view similar to view 2 taken from the opposite direction.

More specifically, and with reference by way of example to FIGS. 2 and 3, the ends 26 of the fixture are aligned at a desired position above an appropriate portion of the T-shaped grid structure. The fixture is thereafter forced downwardly with resultant inward camming of the hook components 40 and/or 40' by virtue of the interaction of the cam surfaces 42 of the hooks and the upper end of the enlargement 14. Simultaneously, the detent 45 will be cammed inwardly by virtue of the coaction of the donwardly directed cam surface thereof with the upper edge or the enlargement 14. With continued downward movement, the fixture will be supported with a hook member 40 or 40' snapped under shoulder 41 of the enlargement, and with detent 45 projecting through slot 46. It will be understood that the attaching actions as described will occur at each end of the fixture and thus the respective ends 26 of the fixture will be securely connected to respective components of grid adjacent the ends.

It will be readily apparent from the foregoing description, the fixture will now be fixed against horizontal movement relative to the T-shaped frame sections, and against any vertical relative movement with respect to such sections. The spacing of the fixtures relative to the grid work of the ceiling, as previously explained, is assured by virtue of the performed and accurately disposed slots 46 formed in the frame sections defining the grid work.

As best seen in FIG. 5, the fixture, and more specifically the louver assembly portion thereof, includes longitudinally directed horizontally projecting ledges 50 which run the entire length of the fixture. As will be perceived from an inspection of FIG. 5 the upper surfaces of the ledges 50 are aligned substantially in the identical plane as the laterally outwardly projecting flanges 15 of the T sections 12. It will thus be appreciated that ceiling board sections, preferably of a size of nominally 8 inch by 48 inches, fill the space between the ledges 50 and the flanges 15, providing a finished and attractive ceiling assembly.

As will be apparent to those skilled in the art and made familiar with the instant disclosure numerous details of construction may be varied from the illustrated embodiment without departing from the spirit of the present invention.

Accordingly, the same is to be broadly construed within the scope of the appended claims.

Having thus described the invention and illustrated its use, what is claimed as new and is desired to be secured by Letters Patent in the United States is:

1. A lighting fixture comprising an elongate housing generally rectangular in plan, said fixture including vertically directed end faces, mounting means on the exterior surface of said end faces, said mounting means being in the form of an inverted U, a pair of laterally, outwardly projecting horizontally directed tile support flanges extending substantially the length of said housing between said end faces, said flanges being disposed at the lowermost portion of said housing, said flanges being adapted to support the edge portions of ceiling tiles.

2. A lighting fixture in accordance with claim 1 wherein said mounting means includes spring detent means positioned to coact with a ceiling grid structure for locking said housing to said structure against relative vertical and lateral movements.

3. A lighting fixture in accordance with claim 2 wherein said spring detent means comprises an outwardly directed, outwardly biased, inwardly deflectable finger portion adapted to be passed through a complemental slot in said grid structure.

4. A ceiling structure including at least one lighting fixture comprising in combination a suspended grid work defining a series of elongate rectangles, including side edges and end edges, said grid work being formed of interconnected frame sections of inverted T-shaped cross section, said sections including a central vertical web and outwardly projecting horizontal flanges extending in opposite directions from the base of said web, an elongate lighting fixture mounted on said grid work and including a housing disposed centrally of a said rectangle, said fixture including end portions supported on the webs of a respective pair of said end edges and side portions, outwardly directed, horizontally disposed ledges of said side portions of said housing, said ledges being disposed in substantial coplanar alignment with and projecting toward said flanges of said frame sections, said ceiling structure including a plurality of tiles, said tiles spanning the spaces between and being supported on said flanges and ledges.

5. A ceiling structure in accordance with claim 4 wherein the widthwise dimension of said fixture is substantially equal to the widthwise dimension of said tiles, said rectangle being filled by a centrally disposed said fixture and a single tile disposed at each side of said fixture and spanning the space between said fixture and said rectangle.

6. A ceiling structure in accordance with claim 5 wherein said end portions of said housing include inverted U-members disposed in a spanning relation of the uppermost edges of said webs of said end edges of said grid work.

7. A ceiling structure in accordance with claim 6 wherein said uppermost edge portions of said webs include longitudinally extending enlargements, and said U-members include hook portions underlying said enlargements to thereby preclude upward relative movement of said U-members and webs.

8. A ceiling structure in accordance with claim 7 wherein said members include cam surface means adjacent said hook portions positioned to coact with said enlargements of said webs to deflect said hook portions from the plane of said webs responsive to downward movement of said U-members relative to said webs.

9. A ceiling structure in accordance with claim 8 and incluuding spring detent means of said housing extending through said webs to thereby lock said fixture to said grid against relative horizontal movement.

10. A ceiling structure in accordance with claim 9 wherein said detent means includes cam means for deflecting said detent means clear of said web responsive to downward movement of said fixture relative to said web.

11. A ceiling structure in accordance with claim 9 wherein said web of said frame sections includes a plurlity of longitudinally spaced apart transverse slots formed therethrough, the longitudinal spacing of said slots corresponding to three times the widthwise dimension of said fixture.

12. A lighting fixture for use in a tiled ceiling structure of the type comprising a grid work forming a series of rectangular openings, said grid work being defined by intersecting frame members in the cross sectional configuration of an inverted T, including a central vertically directed leg having an enlargement at its upper end and a pair of outwardly projecting horizontal ledge portions at the lower end of said leg, said grid work including a plurality of regularly longitudinally spaced apart transverse slots extending therethrough, said fixture having a longitudinal dimension substantially equal to the length of said rectangles and a width dimension of one third of the widthwise dimensions of said rectangles, end faces on the longitudinal extremities of said housing, mounting brackets on said end faces, said brackets being of the configuration of an inverted U, said brackets being spaced to encompass and support said housing on the enlargements of the frames forming an opposed pair of sides of a said rectangle, said housing including a parallel pair of outwardly directed flange members forming the lower side edges thereof, the upper surfaces of said flange members being disposed in substantial coplanar alignment with the upper surfaces of said ledge portions in the supported condition of said housing on said grid work, whereby rectangular ceiling board of substantially the same widthwise dimension of said housing in plan may be supported between said flanges and said ledges.

* * * * *